US005588259A

United States Patent [19]

Kolefas

[11] Patent Number: 5,588,259

[45] Date of Patent: Dec. 31, 1996

[54] SUPPORTING ARM WITH LOCKING MEANS FOR A HINGED PANEL

[76] Inventor: Chris Kolefas, 1017 Edgewood La., Fort Lee, N.J. 07024

[21] Appl. No.: 276,098

[22] Filed: Jul. 15, 1994

[51] Int. Cl.[6] ..... E05B 65/06

[52] U.S. Cl. ..... 49/394; 292/268

[58] Field of Search ..... 49/394; 292/265–272

[56] References Cited

U.S. PATENT DOCUMENTS 179,308 6/1876 Hill ..... 292/269

FOREIGN PATENT DOCUMENTS 194161 7/1907 Germany ..... 292/265

2619700 11/1977 Germany ..... 292/268

23265 of 1898 United Kingdom ..... 292/268

2255586 11/1992 United Kingdom ..... 292/268

*Primary Examiner*—Kenneth J. Dorner

*Assistant Examiner*—Jerry Redman

[57] ABSTRACT

A device for supporting a hinged panel in an open position and for locking the panel in a closed position. A first embodiment of a device according to the present invention comprises an arm with an inverse-L shaped slot for receiving therein a pin attached to the swinging end of the panel. When the pin is in a first leg of the slot, the panel is allowed to swing open. When the pin is in a second leg of the slot, the panel is locked in the closed position. A further embodiment of the device of the present invention comprises a retaining device for preventing the arm from pivoting when the panel is closed, thereby locking the panel in the closed position.

18 Claims, 6 Drawing Sheets

SUPPORTING ARM WITH LOCKING MEANS FOR A HINGED PANEL

TECHNICAL FIELD

The present invention relates to devices for supporting a hinged panel in an open position and to devices for locking such a panel in a closed position. More specifically, the present invention relates to a supporting arm for a hinged panel with integral means for locking the hinged panel.

BACKGROUND OF THE INVENTION

It is often desirable to provide a hinged panel, such as a window or hatch, with means for supporting the panel in an open position. For this purpose, a solution is to provide an arm which is pivotally attached to a stationary frame surrounding the panel and which has an elongated slot for receiving therein a pin attached to the panel. To maintain the panel in an open position, the pin is typically tightened to the arm or captured within notches in the elongated slot.

It is also often desirable to be able to lock the hinged panel in a closed position. For this purpose, it is known to provide a hook, or dead-bolt attached to the frame for preventing the hinged panel from being swung open.

SUMMARY OF THE INVENTION

The present invention provides a device that combines the functions of supporting a hinged panel in an open position and locking the panel in a closed position. An embodiment of the device in accordance with the present invention comprises a supporting arm with one end pivotally attached to a bracket fixed to a stationary frame surrounding the panel, and a slot in the approximate shape of an "L" for slidably receiving a pin attached to the hinged panel. While the panel is in an open position, the pin travels within a first part of the L-shaped slot. In the locked position, the arm is moved so as to engage the pin in a second, shorter part of the slot which is approximately perpendicular to the first part.

As described more fully below, several variants and additional features can be added to the basic configuration.

DETAILED DESCRIPTION OF THE DRAWINGS

Figures 1A, 1B:
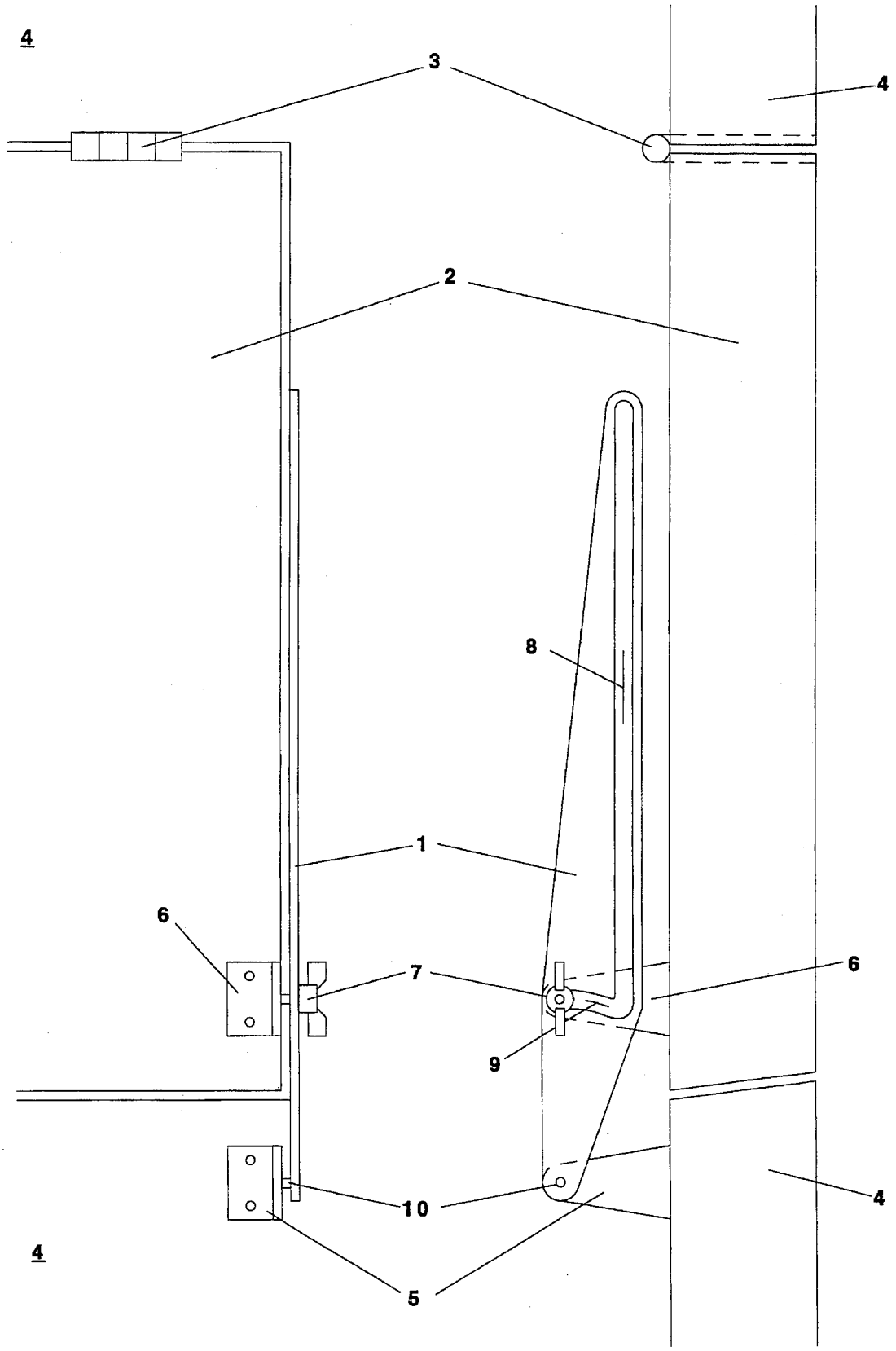
FIGS. 1A and. 1B are a plan and cross-sectional view, respectively, of a hinged panel provided with a first embodiment of the device of the present invention.

FIG. 1A, in plan view, and FIG. 1B, in cross-sectional view, show a panel 2, such as a window, within a stationary frame 4. The panel 2 is attached at its top to the frame 4 by a hinge 3. With reference to FIG. 1B, the hinge 3 allows the panel 2 to pivotally swing toward the left (or inwardly.) A bracket 5 is attached to the frame 4 and a bracket 6 is attached to the panel 2.

An arm 1 is pivotally attached at its lower end to the bracket 5 at a pivot point 10. As seen in the view of FIG. 1B, the arm 1 comprises an approximately backwards-L-shaped slot, with two slot legs 8 and 9, for slidably receiving therein a pin 7 attached to the bracket 6. The pin 7 protrudes from the bracket 6 in a direction parallel to the plane of the panel 2. The slot leg 8 extends generally along part of the length of the arm 1, beginning just short of the upper end of the arm 1 and extending down to a point on the arm at which the pin 7 meets the arm when the arm and the panel 2 are in the closed position. At the latter point on the arm 1, the slot leg 8 joins the slot leg 9 at generally a right angle. Preferably, the slot leg 9 is arched about pivot point 10 with a radius equal to the distance between the pin 7 and the pivot point 10 when the panel 2 is in the closed position (as it is shown in FIGS. 1A and 1B).

To lock the panel 2 in the closed position using the device of the present invention, the arm 1 is rotated toward the panel 2 so that the pin 7 is within the slot leg 9. When the arm 1 is in this position, the panel 2 cannot be swung inwardly. To do so, the arm 1 must be rotated away from the panel 2 so that the pin 7 enters the slot leg 8 and is thus allowed to slide along the length of slot leg 8, as would occur when the panel 2 is swung inwardly.

It should be noted that the length of each of the slot legs 8 and 9 will depend on the particular application. The length of the slot leg 8 will depend on the size of the panel 2 and the maximum extent to which the panel 2 is to be allowed to open. The length of the slot leg 9 should be chosen so that even with some play between the slot leg 9 and the pin 7 while in the locked position, there is a safe margin to prevent the pin 7 from slipping into the slot leg 8 when the panel 2 is forced inwards.

Figure 2:
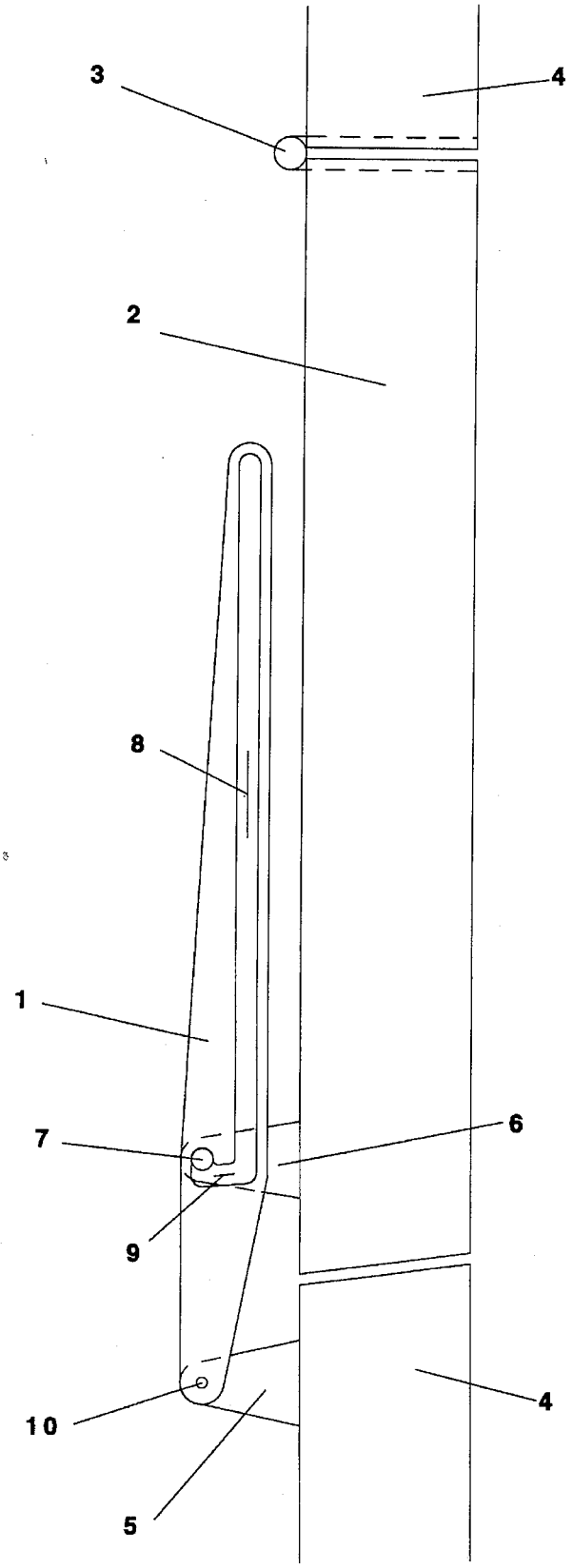
FIG. 2 is a cross-sectional view of a hinged panel provided with a second embodiment of the device of the present invention.

FIG. 2 shows another embodiment of the device of the present invention with a modified slot leg 9 (with like reference numerals denoting like elements). In this embodiment, the end of the slot leg 9 opposite the end at which the two slot legs 8 and 9 join, is closer to the pivot point 10 than is the end at which the two slot legs 8 and 9 join. In addition, an upwards extending notch 9*a* is provided in the slot leg 9 at the end opposite from the end at which the two slot legs join. As a result, as the arm 1 is swung into the locking position, the pin 7 is pulled slightly towards the pivot point 10. In the fully locked position, the pin 7 snaps into the notch 9*a* and is secured therein. This provides for a secure, positive locking arrangement.

So that the arm 1 can support the panel 2 in an open position, the pin 7 can be provided with a friction fitting, such as a nylon collar which would prevent the pin 7 from sliding within the slot leg 8 without the application of an external force to overcome the friction. Another alternative would be to provide the pin 7 with a threaded part for receiving a butterfly nut (as shown in FIGS. 1A and 1B) or other such tightening means so as to create the necessary friction between the arm 1 and the pin 7 to be able to support the panel 2 in an open position. The friction fitting or threaded tightening means can also be used to secure the pin 7 in the locked position.

Figure 3:
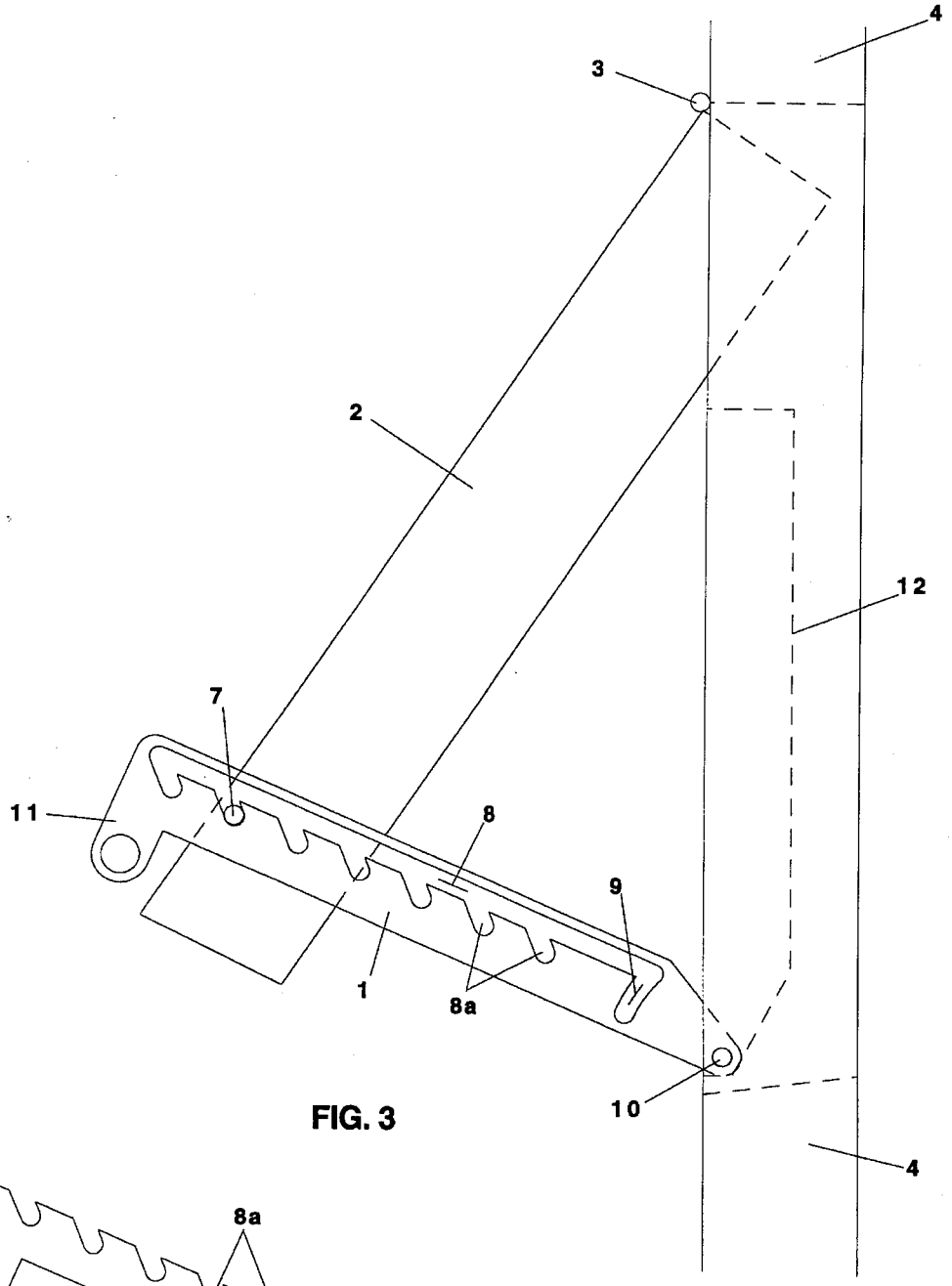
FIGS. 3 and 3A are cross-sectional views of a hinged panel provided with a third embodiment, and a variation thereof, of the device of the present invention.

FIG. 3 shows yet another embodiment of the device of the present invention, in which the slot leg 8 is provided with notches 8*a* for receiving the pin 7 therein. The weight of the panel 2 forces the pin 7 down into one of the notches 8*a*, thereby keeping the panel 2 open in one of several selectable positions. To close the panel 2, a user would push the arm 1 up slightly thereby causing the pin 7 to slide down to the next lower notch 8*a* until the panel is ultimately in the closed position. The panel 2 can then be locked, as described above, by swinging the arm 1 into the locking position.

Figure 3A:
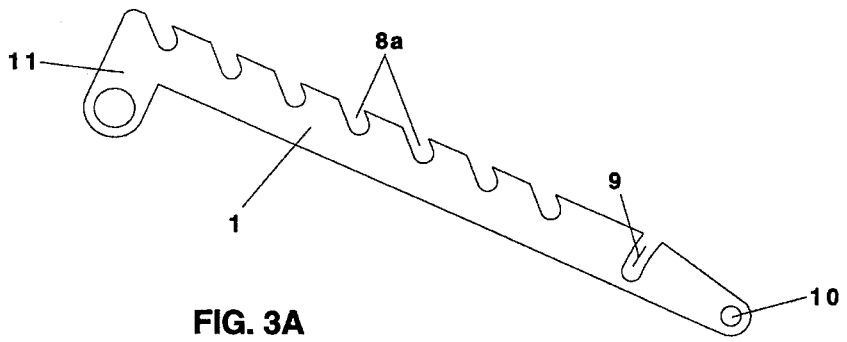

FIG. 3A shows a variant of the embodiment of FIG. 3 in which the slot 8 has effectively been eliminated by removal of the arm material above the slot. In this case, the top edge of the arm 1 is provided with the notches 8*a*. With this variant, the panel can be quickly and easily closed by pulling the arm 1 down, away from the pin 7, and allowing the panel 2 to freely swing to the closed position. To lock the panel, the arm 1 can be swung into the locking position, as before.

It should be noted that the assembly comprising the arm 1, and the brackets 5 and 6 can be placed in a variety of positions relative to the panel 2 and the frame 4. As shown in FIGS. 1A and 1B, the aforementioned assembly is placed along a vertical edge of the panel 2, with the arm 1 swinging inwards alongside the panel 2, as the panel 2 swings inwards. A mirror image of this assembly can also be placed alongside the other vertical edge of the panel 2, thereby having one assembly at both vertical edges or only one, on either the left or right vertical edge, depending on the particular application.

It should also be noted that the assembly comprising the arm 1 and brackets 5 and 6 can also be placed so that the arm 1 swings in a plane between the vertical edges of the panel 2, preferably equidistantly between the two vertical edges. In this case, however, bracket pin 7 must be positioned sufficiently low enough, relative to the lower horizontal edge of the panel 2, to ensure that the arm 1 does not interfere with the panel 2 when it is swung open (or inwards). This can be achieved by re-shaping the bracket 6 in an up-side-down L shape with the pin 7 held adequately below the lower horizontal edge of the panel 2.

The aforementioned assembly can also be placed in different vertical positions relative to the panel 2. In FIGS. 1A and 1B, the bracket 5 is shown attached to the frame 4 at a position below the lower horizontal edge of the panel 2. By rotating the bracket 5 180° about an axis perpendicular to the plane of the frame 4 and placing it on the other side of the arm 1, the entire assembly can be placed higher, so that the bracket 5 is higher than the lower horizontal edge of the panel 2. This configuration may be preferable in applications where space below the panel 2 is limited.

Also, as shown in FIG. 3, it is possible to entirely recess the arm 1 between the panel 2 and the frame 4. The pin 7 and the pivot point 10 are between the inner and outer walls of the panel 2 and the frame 4, with the arm 1 swinging in a plane between a vertical edge of the panel 2 and an adjacent vertical edge of the frame 4. There should be adequate clearance between the aforementioned edges to allow for receiving therein the arm 1 in the locking position. For this purpose, the aforementioned vertical edge of the frame 4 is provided with a pocket 12 for receiving therein the arm 1 when it is in the locking position.

In the embodiment of FIG. 3, when the arm 1 is in the locking position, it is swung into a position that is entirely between the inner and outer surfaces of the panel 2 and frame 4. As such, a handle 11 is provided on the arm 1 so that when the arm 1 is in the locking position, the handle 11 protrudes beyond the inner surface of the frame 4 and the closed panel 2. As such the handle 11 can be used to pull the arm 1 out from, or to push it into, the locking position.

It should also be noted that the device of the present invention can also be used in applications where the panel 2 is hung from vertically-oriented hinges, such as a casement window, for example.

Figure 4:
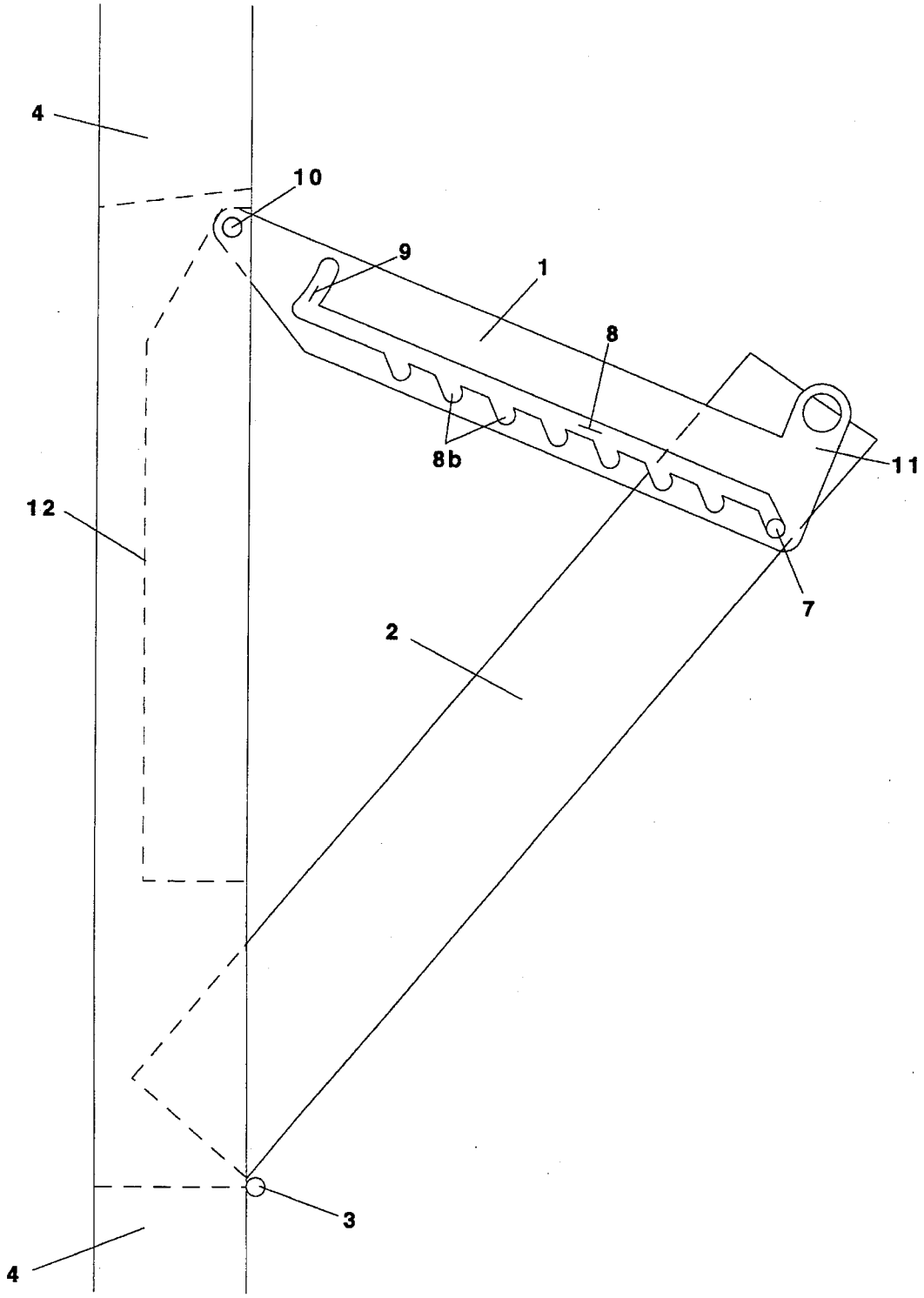
FIG. 4 is a cross-sectional view of a hinged panel provided with a fourth embodiment of the device of the present invention.

The device of the present invention can also be used with a panel which is hinged from its lower horizontal edge (as opposed to its upper horizontal edge, as depicted in FIGS. 1A, 1B, 2, and 3). FIG. 4 shows the embodiment of FIG. 3 adapted for such a use. In FIG. 4, the panel 2 is hinged to the frame 4 by means of the hinge 3, which is in this case is attached to the lower horizontal edge of the panel 2. In this case, the arm 1 is almost identical with that of FIG. 3, except that instead of having a set of notches 8*a* along the slot leg 8, the arm 1 has a set of notches 8*b*. The notches 8*b* extend from the opposite side of the slot leg 8 than do the notches 8*a* and are oriented in a direction generally parallel to that of the notches 8*a*. In the embodiment of FIG. 4, to close the panel 2, a user would simply push up on the panel 2.

Figure 5:
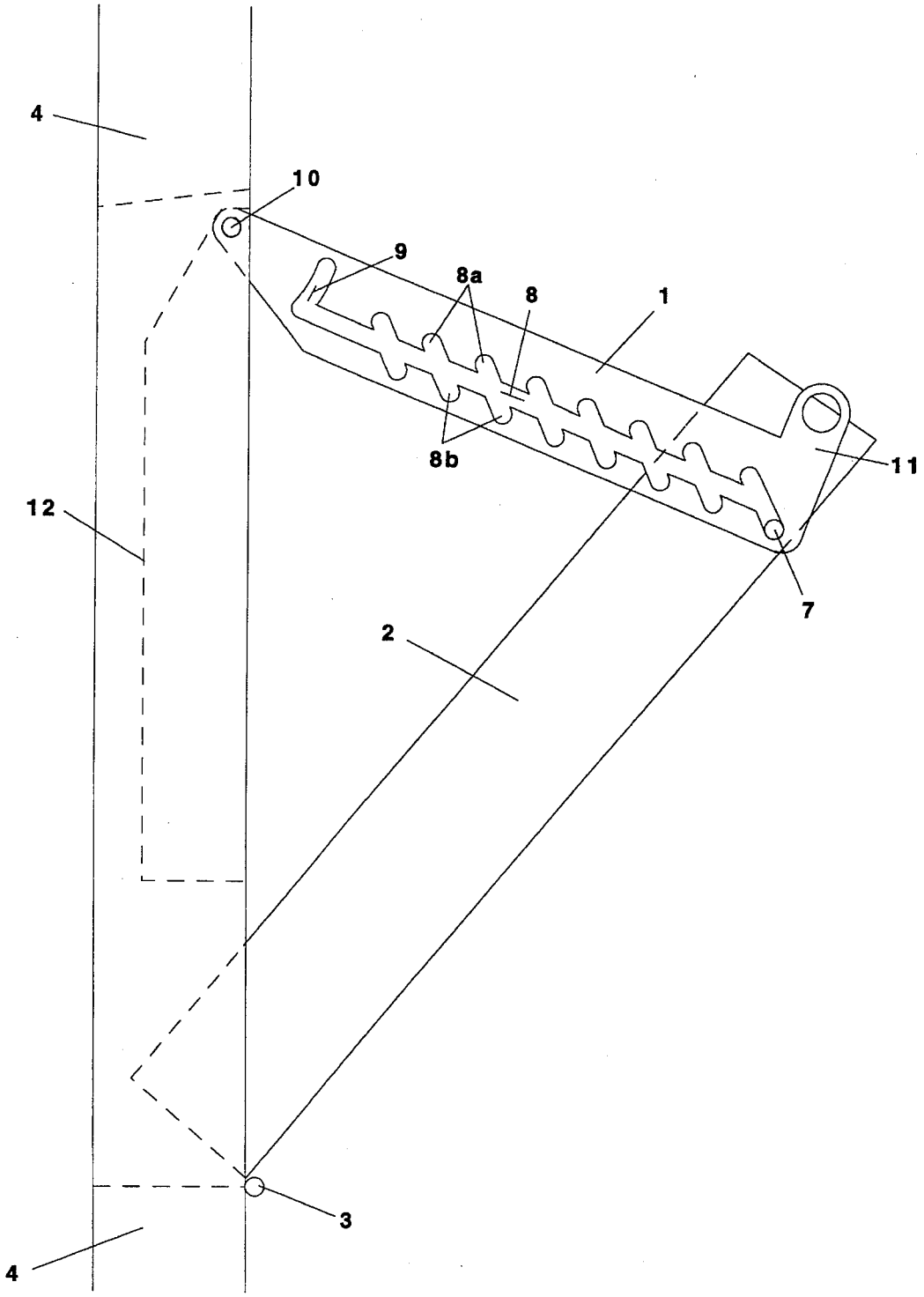
FIG. 5 is a cross-sectional view of a hinged panel provided with a fifth embodiment of the device of the present invention.

FIG. 5 shows yet another embodiment of the arm 1. In this embodiment, the slot leg 8 is provided with both notches 8*a* and 8*b*. This embodiment of the arm 1 can be used in both applications described above with respect to FIG. 3 and 4; i.e., the same arm 1 can be used in applications in which the panel 2 is hinged from above and in applications in which the panel 2 is hinged from below.

In this connection, it should also be pointed out that the embodiment of the arm 1 shown in FIGS. 1A and 1B can likewise be used in applications in which the panel 2 is hinged from above and in applications in which the panel 2 is hinged from below.

Figure 6B:
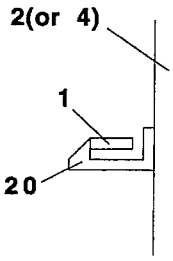
FIGS. 6A through 6G are several views of a hinged panel provided with a fifth embodiment, and variations thereof, of the device of the present invention.
Figure 6D:
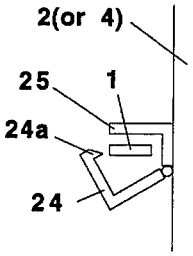
Figure 6C:
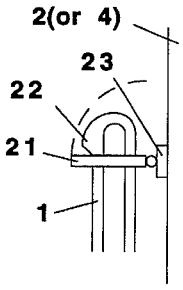
Figure 6E:
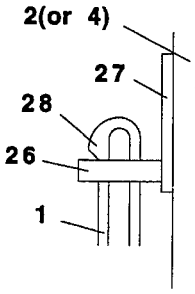
Figure 6F:
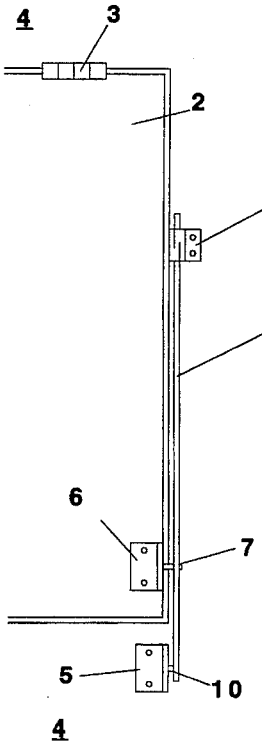
Figure 6G:
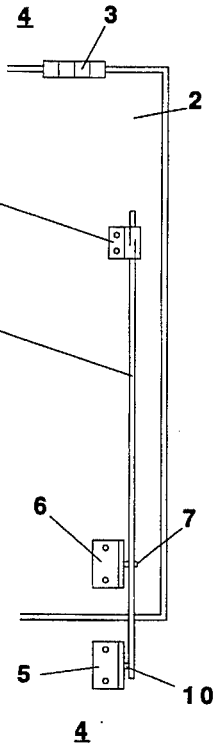
Figure 6A:
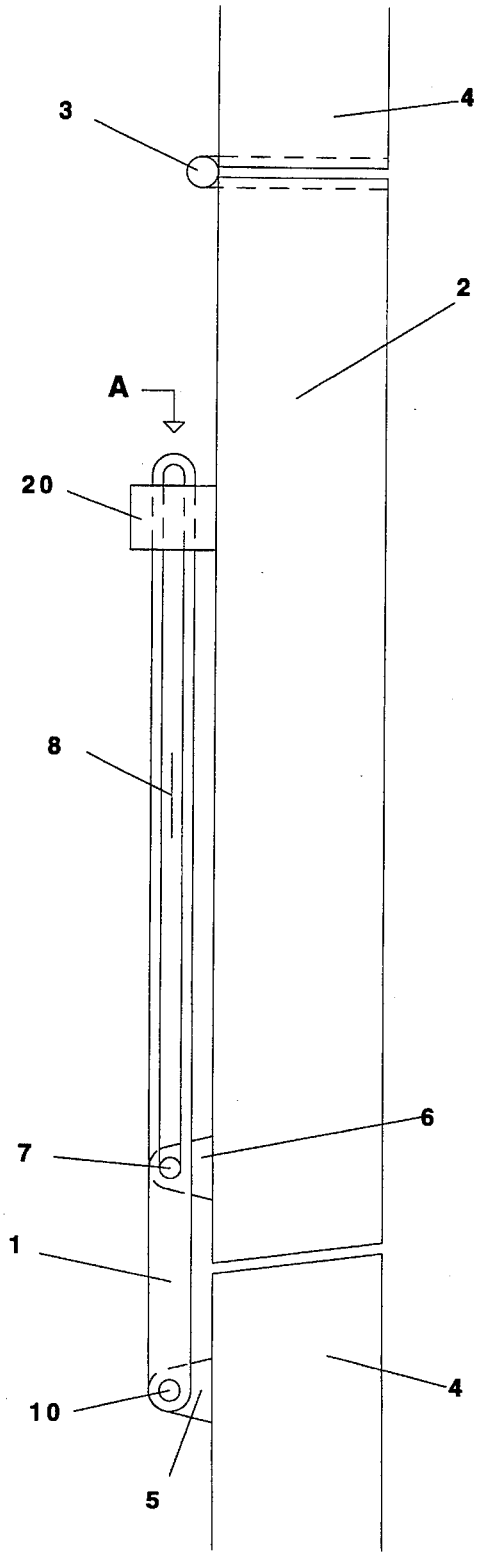

FIGS. 6A through 6G show a final embodiment of a device in accordance with the present invention. In this embodiment, the arm 1, is provided with only one slot leg 8, extending along most of the length of the arm. In order to lock the hinged panel 2 in the closed position, the arm 1 is retained by a retaining device 20 in the position occupied by the arm when the panel is closed; i.e., in the embodiment of FIG. 6A, the retaining device holds the arm 1 substantially parallel to the inner surface of the panel 2. As such, the retaining device 20 does not allow the arm 1 to swing inwards, as it must for the panel 2 to open. To allow the panel 2 to open, the arm 1 must be released from the retaining device 20. The retaining device 20 can be attached either to the frame 4, as shown in FIG. 6F, or to the hinged panel 2, as shown in FIG. 6G. In either case, the retaining device 20 prevents the arm 1 from pivoting, thus keeping the pin 7 and the hinged panel 2 in a locked position.

FIG. 6B is a view, from above (i.e., in the direction of line A), showing the arm 1 retained by the device 20. In this embodiment, the device 20 is advantageously made of a resilient material which can be flexed to allow release of the arm 1 from the barbed end of the retaining device.

FIG. 6C shows another device which can be used to retain the arm 1 in a locked position. In this case, a U-shaped (as seen from above, not shown) loop 21, which is hinged at its open end to a base part 23 attached to the panel 2 (or frame 4, depending on the installation), can be swung over the arm 1 when in the closed position to secure the arm in the closed position. The loop 21 can be kept in the locked position by its weight alone and simply swung up to release the arm.

The loop 21 can also be biased by a spring (not shown) towards an unlocked position; i.e., to stand vertically. This makes closing the panel more convenient by ensuring that the loop 21 will not be in the locked position to interfere with the swinging of the arm 1 into its closed position. In this case, to retain the loop 21 in the locked position, the arm 1 is provided with a barb-like protrusion 22. To release the loop 21 (and thus also the arm 1), a user would flex the arm 1 slightly towards the panel 2 to allow the loop 21 to clear the barb-like protrusion 22.

FIG. 6D is a view, from above, of another device which can be used to retain the arm 1 in a closed position. In this case, the arm 1 is retained within two L-shaped parts 24 and 25 which are hinged together. The part 25 is attached to the panel 2 (or frame 4) and the part 24, which is provided with a lip 24*a* at its free end, can be swung across the arm 1 and retained in a closed position by the engagement of the lip 24*a* to the part 25.

FIG. 6E shows yet another device which can be used to retain the arm 1 in a closed position. In this case, a U-shaped loop 26 is slidably coupled to a plate 27 attached to the panel 2 (or frame 4) and can slide to an upper position, away from the arm 1, or down to a lower position, around the arm 1. As with the retaining device of FIG. 6C, the loop 26 can be allowed to go down, around the arm 1, by its own weight or it can be spring-biased to normally be in the upper position and held in the lower position by a barb-like protrusion 28 on the arm 1.

It should be clear to the person of ordinary skill in the art that several different combinations of the features of the disclosed exemplary embodiments are possible. For example, the shorter, notched slot leg 9 of FIG. 2 can readily be combined with the notched slot leg 8 of FIGS. 3–5.

In addition, it should also be clear that various equivalent implementations of the disclosed features are possible. For example, the slots 8 and 9 can also be implemented as grooves recessed into either or both sides of the arm 1.

What is claimed is:

1. A device used to support a hinged panel in an open position and to lock the hinged panel in a closed position, the hinged panel being hinged to a fixed structure, the device comprising:

a pivot point secured to the fixed structure;

a pin secured to the panel; and a movable arm pivotally attached at a first end to the pivot point and including a slot for receiving the pin therein, the slot having a first slot leg and a second slot leg connected with an end of the first slot leg, so that the panel is in a locked position when the pin is in the first slot leg and in an open position when the pin is in the second slot leg, wherein the movable arm is substantially planar.

2. The device of claim 1, wherein the first slot leg is substantially in the shape of an arc centered about the pivot point and having a radius equal to a distance between the pivot point and the pin when the panel is in a closed position.

3. The device of claim 1, wherein the pin includes a friction device for providing friction between the pin and the arm.

4. The device of claim 1, wherein the second slot leg includes notches for receiving the pin and holding the pin therein against the weight of the panel.

5. The device of claim 4, wherein the movable arm includes notches on both sides of the second slot leg.

6. The device of claim 4, wherein the pivot point is below an edge from which the panel is hinged.

7. The device of claim 4, wherein the pivot point is above an edge from which the panel is hinged.

8. The device of claim 1, wherein the arm further includes a handle.

9. The device of claim 1, wherein the pivot point and pin are respectively secured by respective brackets.

10. The device of claim 1, wherein the first slot leg includes a notch, with the end of the first slot leg that is connected to the second slot leg and an end of the notch being further from the pivot point than an intermediate point of the first slot leg.

11. The device of claim 1, wherein the pin is located between an inner and outer surface of the hinged panel and the pivot point is located between an inner and outer surface of the fixed structure.

12. A device used to support a hinged panel in an open position and to lock the hinged panel in a closed position, the hinged panel being hinged to a fixed structure, the device comprising:

a pivot point secured to the fixed structure;

a pin secured no the panel; and a movable arm pivotally attached at a first end to the pivot point and including a slot for receiving the pin therein, the movable arm being substantially planar; and a retaining device for retaining the arm in a locked position by preventing the am from pivoting about the pivot point when the hinged panel is in the closed position.

13. The device of claim 12, wherein the retaining device is attached to the hinged panel.

14. The device of claim 12, wherein the retaining device is attached to the fixed structure.

15. The device of claim 12, wherein the retaining device is biased towards an unlocked position.

16. The device of claim 12, wherein the pin includes a friction device for providing friction between the pin and the arm.

17. The device of claim 12, wherein the slot includes notches for receiving the pin and holding the pin therein against the weight of the panel.

18. The device of claim 12, wherein the pin is located between the pivot point and the retaining device when the movable arm is in the locked position.

* * * * *